United States Patent [19]

Carroll

[11] 4,048,777

[45] Sept. 20, 1977

[54] BUILDING DECK STRUCTURE

[75] Inventor: Frank E. Carroll, Barrington, Ill.

[73] Assignee: Carroll Research, Inc., Rolling Meadows, Ill.

[21] Appl. No.: 648,500

[22] Filed: Jan. 12, 1976

Related U.S. Application Data

[63] Continuation-in-part of Ser. No. 457,996, April 4, 1974, Pat. No. 3,965,641.

[51] Int. Cl.[2] ..... E04C 1/00; E04C 3/04; E04B 5/10

[52] U.S. Cl. ..... 52/309.12; 52/338; 52/576

[58] Field of Search ..... 52/376, 729, 339, 576, 52/577, 333, 309.12, 309.4–309.11

[56] References Cited

U.S. PATENT DOCUMENTS

| | | | |
|---|---|---|---|
| 854,391 | 5/1907 | Voshardt | 52/376 |
| 1,360,720 | 11/1920 | Brown | 52/729 |
| 2,167,836 | 8/1939 | Greulich | 52/376 |
| 3,848,364 | 11/1974 | Costruba | 50/731 |

FOREIGN PATENT DOCUMENTS

| | | | |
|---|---|---|---|
| 379,861 | 4/1940 | Italy | 52/731 |
| 946,174 | 1/1964 | United Kingdom | 52/729 |

*Primary Examiner*—John E. Murtagh

*Attorney, Agent, or Firm*—Thomas W. Speckman

[57] ABSTRACT

A sheet metal structural shape for use as a stud or mullion in wall construction or a purlin or sub-purlin in deck construction which is symmetrical about a vertical bisecting plane having a central vertical web, two diagonal legs projecting downwardly from one end of the web forming an included angle of about 30° to about 90°, each of the diagonal legs having a leg projecting downwardly at its extremity in a plane substantially parallel to the web, each of the parallel legs having flanges extending outwardly at their extremity, a closure side extending between the extremities of the flanges enclosing the area formed by the diagonal sides, parallel sides and closure side, and a stiffening member at the other end of the web. A wall structure utilizing a spaced series of tne metal structural shapes with a wall material attached to the flanges of adjacent structural shapes. Also included in this invention is a double wall construction wherein a second wall material is attached between adjacent metal structural shapes to a flat face of the stiffening member of the structural shape. The wall structure is particularly suited to shaft wall construction. A poured concrete or a precast deck structure utilizing a series of the metal structural shapes of this invention providing deck structures of superior insulation, fire resistance and uplift resistance.

11 Claims, 7 Drawing Figures

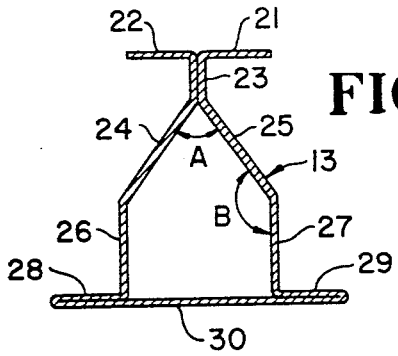
FIG. 2
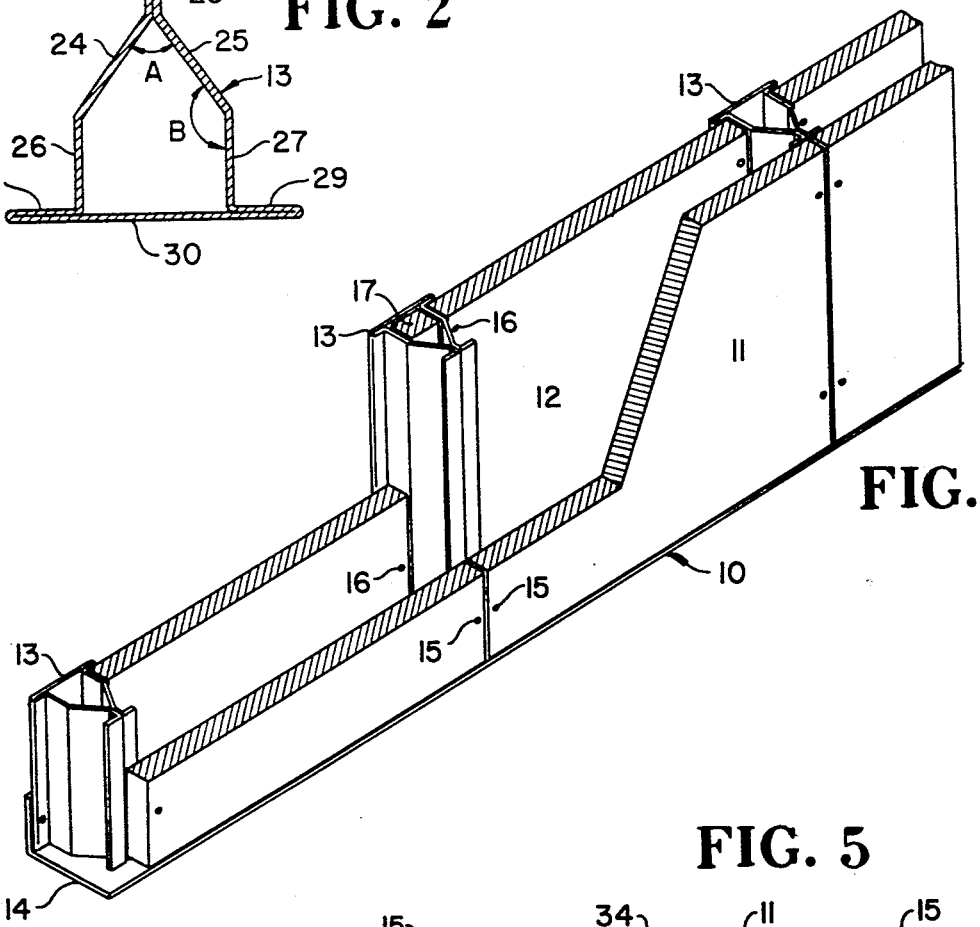
FIG. 1
FIG. 5
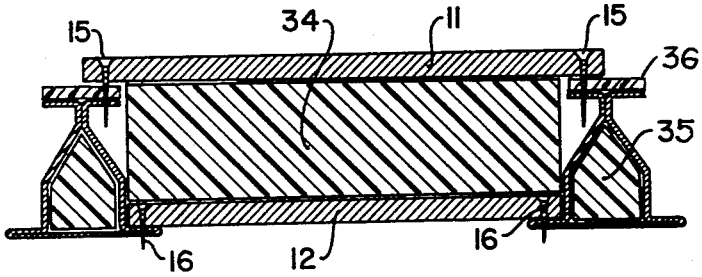
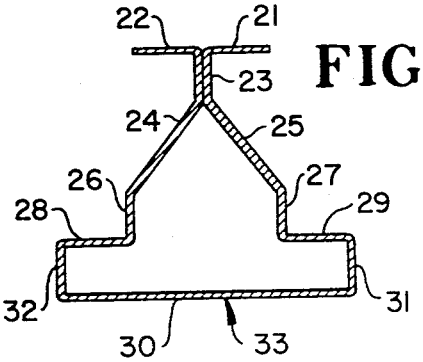
FIG. 3
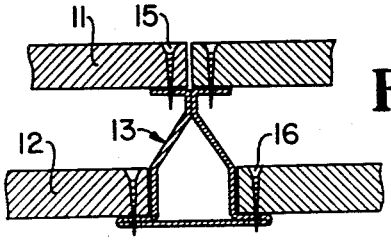
FIG. 4

BUILDING DECK STRUCTURE

CROSS REFERENCE TO RELATED APPLICATION

This application is a continuation-in-part of my earlier filed application Ser. No. 457,996, filed Apr. 4, 1974, now U.S. Pat. No. 3,965,641.

This invention relates to a sheet metal structural shape and its use in building construction. The structural shape is particularly useful as a stud or mullion in wall construction or as a purlin or sub-purlin in deck construction. This invention includes interior and exterior building wall construction using the sheet metal structural shape of this invention. This invention includes interior deck and roof deck construction using the sheet metal structural shape of this invention.

The wall construction according to this invention provides erection processes wherein all of the structural steel, the studs or mullions, may be completely erected and the wall material applied thereafter from one side. This is especially important in shaft wall construction where it is important to effect early closure of a dangerous open shaft. Previous methods of shaft wall erection, such as disclosed in U.S. Pat. No. 3,702,044, require that the closure walls and the studs be erected together by fitting the wall board into the slot of the stud creating a dangerous work environment at the edge of a shaft.

The structural shape of this invention is particularly useful as a sub-purlin or purlin in an insulated roof structure and method providing superior fire protection and insulation properties. The deck or roof structure of this invention may be a poured gypsum or other poured concrete-like deck system wherein gypsum formboard is laid on novel sheet metal structural shape sub-purlin or purlin stucture. A foamed synthetic organic polymer board having openings vertically therethrough to permit moisture from the poured concrete to penetrate to the gypsum formboard for drying is placed adjacent and above the formboard. Reinforcing wire mesh, the poured concrete and a standard weatherproof barrier is then applied resulting in a unitized structure affording high strength, high insulation properties, fire resistance and design versatility. Precast boards may also be used between the structural shapes for decks according to this invention.

Previously, most efficient integral insulation properties were most frequently obtained when conventional metal roof decks were installed followed by foam insulation covered with a weatherproof barrier or traffic layer, such as bitumen and roofing felt. However, such strutures do contribute to the spread of a fire in a building under such a metal roof deck. U.S. Pat. No. 3,466,222 is illustrative of recent attempts to overcome such disadvantages. However, the structure shown in U.S. Pat. No. 3,466,222 only slows down fire damage and does not eliminate it, the roof being susceptible to total destruction by the foam disintegrating and permitting the weatherproofing materials to burn even when utilizing an expensive metal deck roof system.

Poured gypsum roof deck systems have long been recognized as economical and furnishing a fireproof roof structure. In the conventional poured gypsum roof deck system, gypsum formboard is laid over the steel sub-purlin assembly, a layer of interwoven steel reinforcing mesh placed over the gypsum formboard and poured in place slurry of gypsum concrete applied to conventional 2 inches thick. Such roof systems are known to provide satisfactory two hour fire ratings and low flame spread ratings. However, attempts to provide insulation to such roof deck systems has not proved satisfactory. One attempt has been to use perlite aggregate in the gypsum concrete, however, this does not give desired insulation properties. Another attempt has been to provide insulation beneath the roof deck structure, however, such insulation either adds to combustion in the interior of the building or is expensive if incombustible mineral fiber is used. Other attempts to provide both satisfactory insulation and fireproof properties have been to utilize formboard which is both fireproof and has insulating properties. Such formboards are those manufactured from mineral fiber materials and fiber glass materials, but these are both expensive and do not provide the desired insulation properties while being more difficult to use in field erection.

It is an object of this invention to overcome the above disadvantages.

It is an object of this invention to provide a sheet metal structural shape which may be used in building construction.

It is another object of this invention to provide a sheet metal structural shape which is especially useful as a stud or mullion in building wall construction.

It is a further object of this invention to provide a wall structure utilizing a series of the metal structural shapes of this invention especially suitable for interior and exterior walls.

It is yet another object of this invention to provide a wall structure particularly well suited for shaft wall construction.

It is another object of this invention to provide a novel sheet metal purlin or sub-purlin design especially suited for poured and prefabricated insulating roof decks.

It is a further object of this invention to provide an economical, insulating and fireproof poured gypsum roof deck system.

It is still another object of this invention to provide a poured gypsum roof deck system having integral thermal insulation properties which provides satisfactory 2-hour fire ratings.

These and other objects, advantages and features of this invention will be apparent from the description and by reference to the drawings wherein preferred embodiments are shown as:

FIG. 1 is a perspective cutaway view of a double wall structure of one preferred embodiment of this invention;

FIG. 2 is a sectional view of one embodiment of a sheet metal structural shape of this invention;

FIG. 3 is a sectional view of another embodiment of a sheet metal structural shape of this invention;

FIG. 4 is a cross-sectional view of the wall shown in FIG. 1;

FIG. 5 is a cross-sectional view of one embodiment of an insulated wall according to one embodiment of this invention;

Figure 6:
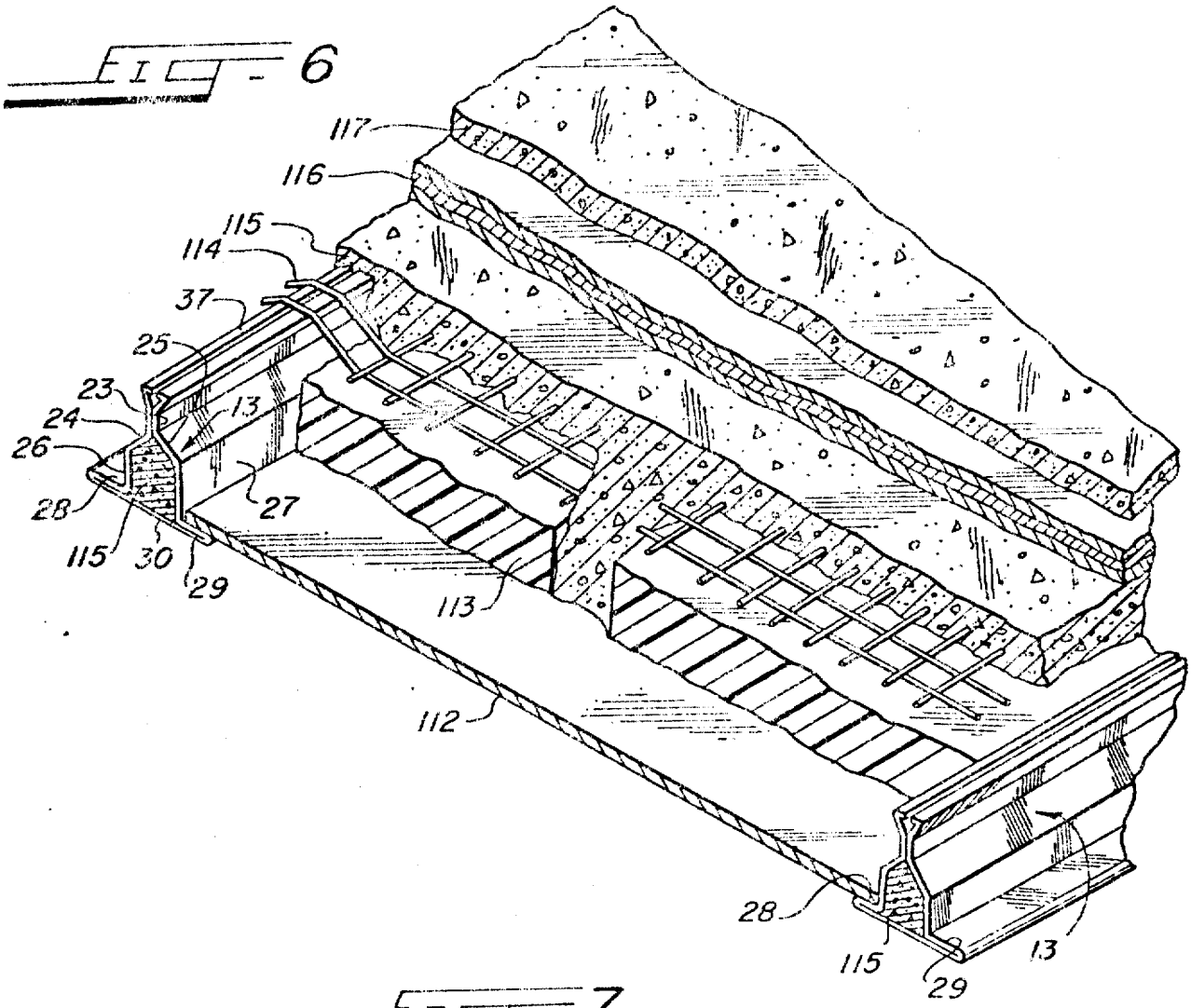
FIG. 6 is a perspective cutaway view showing a poured roof deck according to this invention.

The sheet metal structural shape of this invention provides excellent structural characteristics while reducing weight and providing a structural shape which can be readily fabricated from sheet metal. It is highly desirable to fabricate structural shapes from sheet metal to minimize energy requirements in production and to conserve steel. Prior attempts to utilize sheet metal shapes in poured roof construction have not been satisfactory. Some prior attempts have utilized sheet metal ⊥ shapes as substitutes for bulb tees in roof deck construction. These sheet metal ⊥ shapes while providing sufficient strength in the composite assembled poured roof do not have satisfactory strength characteristics themselves and in the erection, bend over or roll when walked upon by the erectors. This results in a very dangerous situation for the workers. The sheet metal structural shapes of this invention provide desirable strength characteristics themselves and sufficient strength characteristics to be walked upon during erection without dangerous bending or rolling.

When used as studs or mullions in wall construction, the sheet metal shapes of this invention provide a wall structure wherein all of the studs or mullions may be erected and then a double wall applied from one side. This is especially important in shaft wall construction, such as in elevator shafts. The sheet metal shape of this invention may also be utilized for other construction purposes, such as supports for suspended ceilings.

Referring to FIGS. 2 and 3, the sheet metal shape of this invention is symmetrical about a bisecting plane through a central web. Shape 13 has a central web 23 from which two diagonal legs 24 and 25 project downwardly for equal lengths at an included angle, shown in FIG. 2 as A, of about 30° to about 90° between the legs having its vertex at the bottom of the web, preferably about 60°. Each diagonal leg has substantially parallel legs 26 and 27 projecting downward at its lower extremity at the angle B. Legs 26 and 27 are parallel and in a plane substantially parallel to web 23. Each of the parallel legs 26 and 27 have a flange 28 and 29, respectively, extending outwardly at their extremity. The space between the parallel legs is closed by side 30. As shown in FIG. 1, side 30 is adjacent to flanges 28 and 29.

Another embodiment of the sheet metal shape of this invention is shown in FIG. 3 wherein side 30 is spaced from flanges 28 and 29 by box sides 31 and 32. Box sides 31 and 32 extend from the extremity of flanges 29 and 28, respectively, in planes substantially parallel to web 23.

The upper edge of web 23 has a structurally stiffening member such as a flange, box shape or a triangle which provide a flat outer surface at substantially 90° to web 23. Preferred flange configurations are shown in FIGS. 2 and 3. The box shaped configuration is shown in FIG. 1b and the triangle configuration in FIG. 1 of the parent application.

The structural shape of this application differs from the shape disclosed in my parent application by parallel legs 26 and 27 and side 30 which closes the space between the parallel legs. Parallel legs 26 and 27 provide greater resistance to deflection along the plane of web 23 to suit desired design characteristics and provide for varying wall thicknesses. Closure side 30 results in a shape which does not spread as a result of forces acting upon diagonal legs 24 and 25. Closure side 30 also provides a shape which provides a raceway for wires, pipes and the like, as well as ducts for distributing conditioned air throughout a building structure. In cases of use for air distribution, openings may be cut in desired locations in closure side 30 and a suitable manifold system located at each end of the shape.

Flanges 28 and 29 may vary in length suitable to hold the desired formboard or other decking or facing material. I have found from about ½ to about 1 inch to be suitable. The height of the diagonal legs 24 and 25 may be varied to suit the strength requirements of the desired span. I have found about 1⅛ to about 4 inches satisfactory when using the shapes as sub-purlins, studs or mullions and about 4 to about 10 inches satisfactory when using the shapes for purlins or other major structural members. The included angle of legs 24 and 25 is suitably about 30° to about 90°, about 30° to about 60° being preferred. Web 23 is important to supply resistance to forces at right angles to the longitudinal axis of the shape and also to prevent bending or rolling of the shapes when they are used in deck structures and walked upon by erection workers. I have found a suitable dimension for web 23 is about ⅜ to ⅝ inch, about ½ inch being preferred. The height of parallel legs may be varied to suit strength requirements of desired spans. About ⅜ to about ¾ inch is satisfactory when using the shapes as sub-purlins, studs or mullions. When using the shapes for purlins or other major structural member, the height may be increased to as much as about 4 inches.

Box sides 31 and 32, as shown in FIG. 3, may be any suitable length to provide desired structural characteristics. Box sides of about ½ to about 2 inches are preferred.

As pointed out above, various forms may be utilized as stiffeners on the upper edge of web 23. A preferred shape of stiffener are flanges 21 and 22 extending in opposite directions at substantially 90° to web 23 as shown in FIG. 2. The stiffener flanges may be of suitable length for holding wall board or other facing material. I have found about ⅜ to about ¾ inch to be suitable. When the stiffener is box or triangle shaped, it is preferred that the sides in parallel planes to web 23 be about 3/16 to about ½ inch, preferably about ¼ inch when the shape is used as a sub-purlin or stud and about ⅜ to about ¾ inch, preferably about ½ inch when the shape is used as a purlin or exterior mullion. It is preferred the flat portion of the box or triangular stiffener by about 5/16 to about ¾ inch, preferably about ½ inch when the shape is used as a sub-purlin or interior wall stud and about ½ to about 1¼ inch, preferably about ¾ inch when the shape is used as a purlin or exterior wall mullion. It is desired that the stiffener shape permit poured concrete or grouting to flow both under and over the stiffener to prevent vertical displacement or uplift when the shape is used in deck construction.

The sheet metal sections of this invention may be fabricated by well known roll forming techniques from sheet steel from about 12 gauge to about 25 gauge, about 16 to 20 gauge being suitable for sub-purlins, about 12 to 16 gauge being suitable for purlins, about 20 to 25 gauge being suitable for interior wall studs and about 12 to 20 gauge being suitable for exterior wall mullions.

One preferred embodiment of a wall structure according to this invention is shown in FIG. 1. The wall structure shown in FIG. 1 is especially well suited for interior and shaft walls. The wall structure shown in FIG. 1 spans the distance between floors or between a floor and a ceiling or roof structure. The wall structure is erected by placing a suitable anchoring structure at the base of the wall, such as sill angle 14, and the corresponding structure at the top or a cap angle. Any suitable shape may be used which provides a backing against which to fasten the sheet metal studs 13 and not obstructing entry of the wall board from the narrow side of studs 13. For example, a channel may be used at the base and an angle at the top. Studs 13, being of sheet metal, may be readily cut to suitable length at the job site, erected at desired spacings and fastened to the sill structure at the bottom and the corresponding cap structure at the top. The sheet metal studs may be spot welded or attached in any other suitable fashion known to the art. It should be noted that in the structure of this invention, all of the studs may be put into place at the desired spacing as soon as the sill and cap structures are installed, this, affording quick and safe protection of open shafts and the like. The studs may be completely installed from the building side of the shaft without the necessity for scaffolding or even leaning into the shaft area. After the spaced studs are erected, the inner shaft wall filler board 12 may be attached to the studs from the building side of the shaft simply by placing the wall board against the flanges of the studs as shown in FIG. 1 and applying screws shown as 16 at desired locations through the inner shaft wall and into the stud flange. While FIG. 1 shows the use of the shape as shown in FIG. 2, the shape shown in FIG. 3 may be used equally as well and in the same manner with the advantage that the screws are completely within the box section of the structural shape.

Outer shaft wall 11 may be applied by placing the outer shaft wall board in the desired position and applying screws of other fastenings through the outer shaft wall board and the flat portion of the stiffener structure of the stud. Thus, the entire double wall assembly may be completely assembled from one side.

A preferred embodiment of a shaft wall is shown in FIG. 1 wherein the studs are spaced on centers of the width of standard available wall board. The inner shaft wall board 12 is cut narrower than the outer shaft wall board 11 to provide insert 17 which fits between the parallel legs 26 and 27 of the structural shape thus providing additional fire resistance to the wall structure. Of course, the space between inner shaft wall 12 and outer shaft wall 11 may be filled with any type of insulation material desired. The wall closure material fastened to the flanges of adjacent structural shapes may be of any suitable material. As shown in FIG. 1, with particular reference to shaft wall construction, gypsum board may be used in interior construction. Alternatively, plywood, various composition boards, metal panels and a wide variety of composition panels with various desired interior surface finishes, may be used to obtain texture, color and acoustical properties. The wall construction of this invention is also suitable for exterior walls and in such cases, the wall closure material facing the exterior would suitably be a weather-resistant material and may be faced with any desired texture or colored material to obtain the desired appearance. For example, Venetian corrugated metal which is available in long rolls and surfaced in a variety of stone and brick textures may be readily cut to length at the job site and applied with self-tapping screws.

For exterior wall construction, the thickness of insulation between the inner and outer wall closure material, shown as 34 in FIG. 5, may be of any desired thickness by utilization of filler blocks 36. Also, in exterior construction as well as interior, the structural shape of this invention may be filled with any suitable insulation material or may be filled with gypsum concrete to provide added fire resistance, shown as 35 in FIGS. 5, 6 and 7. When utilizing the building wall structure of this invention for exterior walls, it is preferred to use the embodiment of the structural shape shown in FIG. 3 for added strength. Thus, either single or double wall construction may be readily obtained by use of the sheet metal structural shapes according to this invention.

It is readily apparent that when the wall structure, as described above, is erected in horizontal or near-horizontal planes, the structures provides a suitable building deck structure. Thus, a building deck structure may be obtained by simply utilizing suitable materials in the decking assembly to provide a suitable ceiling structure shown as 12 in FIG. 5, suitable insulation, if desired, shown as 34 in FIG. 5, and a suitable floor structure shown as 11 in FIG. 5, the decking assembly made up of the ceiling structure 12, insulation 34 and floor structure 11, may be prefabricated and set in place as a unit using fasteners 15. In such case, fasteners 16 may be eliminated or, if desired, driven from the opposite direction then shown in FIG. 5. For interior decks, the ceiling structure 12 may be any suitable acoustical material while the deck surface structure 11 may suitably be plywood with polystyrene or polyurethane foam between.

The sheet metal structural shape of the present invention may also be directly substituted for the structural shape disclosed and claimed in my parent application, Ser. No. 457,996, now U.S. Pat. No. 3,965,641 for use in both poured concrete deck structures, as illustrated in FIG. 1 of that application, or in prefabricated or precast roof structures as illustrated in FIG. 2 of that application, which has been indicated by the U.S. Patent Office as allowable.

Figure 7:
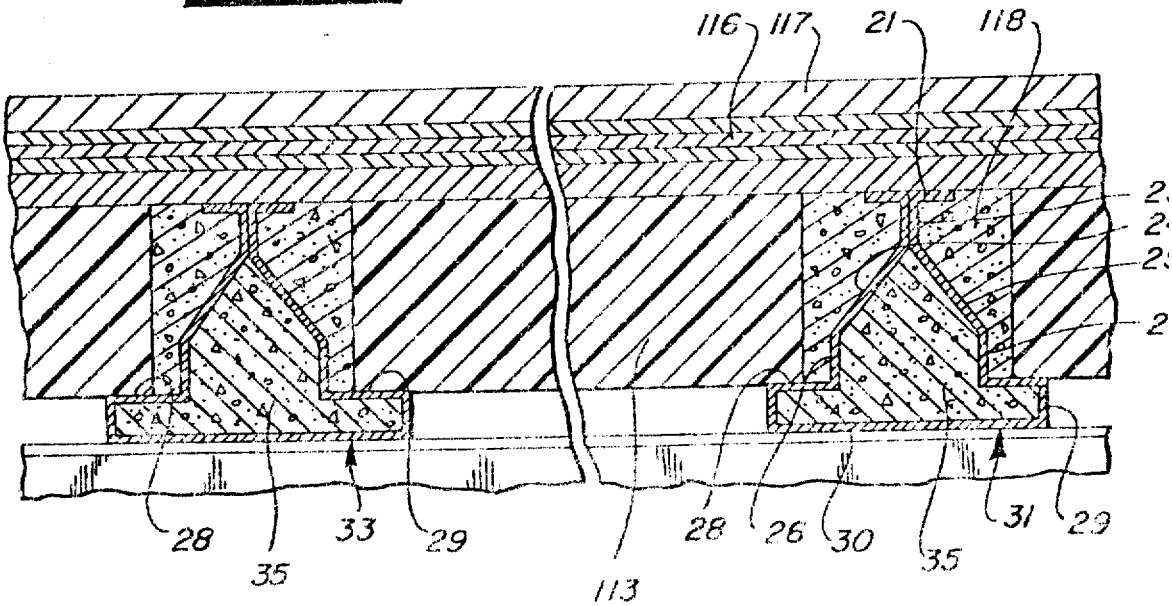
FIG. 7 is a perspective cutaway view showing a precast slab roof deck according to this invention.

The structural sheet metal shapes 13 and 33 of this invention may be used as sub-purlins and supported by any suitable structural members such as open web joists and I beams spaced at proper intervals, making a suitable roof support member system as shown in FIGS. 6 and 7. Any roof support member system suitable for support of a poured roof is satisfactory. Gypsum formboard 112 having a desired thickness of synthetic organic polymeric foam 113 may be placed in contact with the upper side of the gypsum formboard, the gypsum formboard resting upon the flanges 28 and 29 of adjacent structural sheet metal shapes of this invention. It is desired that the polymeric foam have openings of more than about 5 percent of the area of the polymeric foam, preferably about 5 to 20 percent of the surface area of the polymeric foam providing communication between the volume above the polymeric foam to the upper surface of the gypsum formboard. Conventionally used wire reinforcing mesh 114 is placed above the polymeric foam and concrete 115 poured to a desired thickness above the polymeric foam, the concrete extending through the above mentioned openings in the polymeric foam to contact the gypsum formboard and the poured concrete flowing both under and over the stiffening member 37 of the sheet metal structural shape of this invention, thereby providing excellent uplift resistance and a composite roof structure.

Any gypsum formboard providing a two hour fire rating when used with poured gypsum slabs is suitable. The least expensive of the gypsum formboards, the rigid one-half thick gypsum formboard is suitable for use in the roof structure of this invention, however, various surfaced gypsum formboards having suitable ceiling surfaces may be utilized as long as the incombustibility and flame spread ratings are satisfactory.

The synthetic organic polymer foam may be any substantially rigid organic polymer foam having good insulating properties and preferably a high temperature at which thermal decomposition occurs. Suitable foams include polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, polisocyanurate and the like. Preferred foams are selected from the group consisting of polystyrene and polyurethane. Particularly suitable foams are closed cell foams which provide high insulating properties and low internal permeability to moisture. Such organic polymer foams are substantially rigid bodies of foam and are well known for their low density and outstanding thermal insulating properties. Previously, use of organic polymer foams in roof structures has been limited due to the need for care and special attention in installation if they are used alone and due to their decomposition at higher temperatures permitting structural damage. In accordance with this invention these disadvantages are overcome and polystyrene may be advantageously utilized.

The organic polymeric foam and the gypsum formboard may be preassembled by fastening the foam to the formboard by any suitable fastening means. Suitable fastening means include synthetic and natural adhesives, wire staples, metal clips and the like. Suitable synthetic adhesives include epoxy, polyurethan, polyamide and polyvinylacetate and its copolymers. Adhesives and wire staples are preferred. The polymer foam and gypsum formboard may also be readily assembled at the construction site by first laying the formboard in place and placing the foam on top of it in a fashion to hold the foam the desired distance from the novel purlins.

Following installation of the gypsum formboard -polymer foam, standard reinforcing wire mesh used in poured gypsum deck assemblies, shown as 114 is applied and gypsum concrete poured to a suitable thickness of about 1½ to about 3 inches over the surface of the polymer foam, about 2 inches being preferred. The poured gypsum concrete flows through openings in the polymer foam and adheres to the upper surface of the gypsum board 112. This structure provides an integral roofing structure having desired fireproof and internal insulation properties.

The gypsum concrete utilized may be preferably standard gypsum concrete. However, modified concretes containing various fillers, such as perlite, aggregate for thermal insulation and lighter weight are suitable, or exploded mica in portland cement is suitable, but not necessary in the roof structure of this invention. The gypsum concrete is especially desirable for use in roof structures not only because it is incombustible but also because the gypsum sets within a few minutes to form a slab that is hard enough to walk upon thereby permitting, in many cases, a waterproof wearing surface to be laid the same day the slab is poured. When any type of portland cement is used, the setting time is much slower and to prevent moisture from sagging the formboard, I have found it necessary to place a moisture permeable sheet between the cement and the top surface of the formboard. I have found that moisture permeable paper, such as gypsum board paper, preferably placed on top of the foam is satisfactory.

A built-up roofing membrane comprising alternate layers of roofing felt and hot asphalt 116 may be applied on top of the concrete with a waterproof wearing surface of tar and gravel 117. Any suitable waterproof wearing surface for flat type roofs is suitable for this roof structure of this invention, or the gypsum concrete may be waterproofed with a plastic membrane, such as on dome-type roof structures.

The drying of the concrete continues by removal of moisture from the concrete for several weeks after pouring. I have found that in using the roof structure of this invention the drying time of the concrete is not greatly increased. This results from the concrete being in communication through holes in the polymer foam with the gypsum formboard which is porous to water. The drying of the concrete after a built-up type roofing membrane is applied to its exterior continues by the moisture escaping through the formboard.

The roof structure of this invention provides properties which are presently being called for by newer building regulations. The first such property is fire ratings which, following suitable ASTM testing, result in 2 hour fire ratings for the roof structure. The second important property is thermal insulation combined with the satisfactory fire rating. Present energy conservation considerations result in a U value of 0.10 and less being desirable. Calculations show that roof structures of this invention utilizing the sheet metal shape as a purlin and using polystyrene and gypsum concrete result in U values of 0.06 and less. When the sheet metal shape is utilized as a sub-purlin with ½ inch gypsum formboard, 1½ inch polystyrene foam board and 2 inch gypsum concrete the U value is 0.10. Thus, an inexpensive deck is provided having both a 2 hour fire rating for Class 1 fire rated construction and insulation properties resulting in U values of 0.10 and less. Further, a range of desired insulating properties may be achieved by varying the thickness of the synthetic polymer foam.

Any suitable ceiling structure may be installed beneath the roof structure of this invention as long as suitable ventilation is furnished. However, in contrast to prior roof structures, it is not necessary that the ceiling provide the insulation or fireproofing qualities. The roof structure of this invention provides high insulation and fireproof properties without any structure beneath it and may be left exposed. Further, when the sheet metal shape of this invention is used directly as a purlin, about one foot of interior occupancy space is gained over conventional construction using exposed joists which must also be fireproofed.

The sheet metal shapes of this invention may also be utilized in roof deck construction utilizing precast fireproof and insulating slabs such as fibrous materials bonded with hydraulic cement binders as shown in FIG. 7. The slabs may be laid on flanges 28 and 29 of the sheet metal shapes 33 and the space between the slabs and the sheet metal shapes is covered from the top with grout 118. Any precast slab affording suitable fireproofing and insulating properties is suitable for use in the deck of this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A building deck structure comprising:

a spaced series of parallel sheet metal structural shapes which are symmetrical about a bisecting plane through a central web having a central web, two diagonal legs projecting downwardly from one end of said web forming an included angle of about 30° to about 90° between said legs and having its vertex at the bottom of the web, said diagonal legs having a vertical height of about 1⅛ to about 10 inches, each diagonal leg having a leg projecting downward at its extremity in a plane substantially parallel to said web, said legs being substantially parallel, each of said parallel legs having flanges extending outwardly at their extremity, a closure side extending between the extremities of said flanges enclosing the area formed by said diagonal sides, said parallel sides and said closure side, and a stiffening member at the other end of said web; and decking assembly having its lower surface resting on said flanges and extending between adjacent structural shapes.

2. The building deck structure of claim 1 wherein said building deck structure comprises:

gypsum formboard resting on said flanges and extending between adjacent structural shapes;

rigid synthetic polymer foam having an underside adjacent the upper side of said gypsum formboard and having spaces vertically communicating from the upper side of said formboard to the upper side of said foam, said spaces having an area of more than about 5 percent of the area of the upper side of said formboard; and poured concrete adjacent the upper side of said foam and around said stiffener to prevent uplift and extending through said spaces contacting the upper side of said gypsum formboard, said concrete completing drying by escape of moisture through said gypsum formboard.

3. The building deck structure of claim 1 wherein said structural shape central web is about ⅜ to about ⅝ inch.

4. The building deck structure of claim 1 wherein said structural shape diagonal legs have a vertical depth of about 1⅛ to about 4 inches.

5. The building deck structure of claim 1 wherein said structural shape diagonal legs have a vertical depth of about 4 to about 10 inches.

6. The building deck structure of claim 1 wherein said structural shape parallel legs are about ⅜ to about 4 inches.

7. The building deck structure of claim 1 wherein said structural shape stiffening member is an inverted isosceles triangle.

8. The building deck structure of claim 1 wherein said structural shape stiffening member is a stiffener flange.

9. The building deck structure of claim 1 wherein said structural shape closure side is spaced from said flanges by box sides extending from the extremity of each flange to each end of said closure side in a plane substantially parallel to said web.

10. The building deck structure of claim 1 wherein said decking assembly comprises prefabricated deck structures.

11. The deck structure of claim 10 having grouting between said prefabricated deck structures and surrounding said stiffening member providing uplift resistance.

* * * * *

UNITED STATES PATENT OFFICE

CERTIFICATE OF CORRECTION

Patent No. 4,048,777 Dated September 20, 1977

Inventor(s) Frank E. Carroll

It is certified that error appears in the above-identified patent and that said Letters Patent are hereby corrected as shown below:

In the drawings, Figures 6 and 7 as shown on the attached sheet should be added.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*